US008650720B2

(12) United States Patent
Wicker et al.

(10) Patent No.: US 8,650,720 B2
(45) Date of Patent: Feb. 18, 2014

(54) SAFETY RETAINER FOR CURTAIN CORD

(75) Inventors: Joe D. Wicker, Memphis, TN (US); Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 185 days.

(21) Appl. No.: 13/401,901

(22) Filed: Feb. 22, 2012

(65) Prior Publication Data

US 2013/0000082 A1 Jan. 3, 2013

(30) Foreign Application Priority Data

Jun. 30, 2011 (TW) ..... 100211984 U

(51) Int. Cl.
*A47H 3/02* (2006.01)
*E06B 9/326* (2006.01)
*A47H 3/10* (2006.01)

(52) U.S. Cl.
USPC ..... 24/115 G; 24/136 R; 160/178.2

(58) Field of Classification Search
USPC ..... 24/136 R, 115 G, 712.5, 712.7; 160/178.1 R, 178.2
See application file for complete search history.

(56) References Cited

U.S. PATENT DOCUMENTS

| | | | | |
|---|---|---|---|---|
| 5,671,505 | A * | 9/1997 | Anscher | 24/115 G |
| 5,737,808 | A * | 4/1998 | Ikeda | 24/115 G |
| 6,038,746 | A * | 3/2000 | Anscher et al. | 24/115 G |
| 6,672,237 | B2 * | 1/2004 | Hillier | 114/230.2 |
| 7,337,503 | B1 * | 3/2008 | Ashbrook | 24/115 G |
| 7,617,574 | B2 * | 11/2009 | Tracy | 24/115 G |
| 8,539,645 | B2 * | 9/2013 | Marocco | 24/136 K |

* cited by examiner

*Primary Examiner* — Robert J Sandy
*Assistant Examiner* — Michael Lee
(74) *Attorney, Agent, or Firm* — Rosenberg, Klein & Lee

(57) ABSTRACT

A safety retainer for curtain cords is revealed. The safety retainer is used to hold a cord used to open and close curtains in place. The safety retainer includes an inner base and an outer base that are disposed with fixing holes. The inner base and the outer base are fixed on a wall while the cord for control of curtains is passed through the fixing holes. Thereby the cord is held in place by the safety retainer to prevent children from pulling out and being strangled by the cord.

1 Claim, 5 Drawing Sheets

SAFETY RETAINER FOR CURTAIN CORD

BACKGROUND OF THE INVENTION

1. Field of the Invention

The present invention relates to a safety retainer for curtain cords, especially to a safety retainer that holds curtain cords in place stably and keeps curtain cords out of reach of children for their safety.

2. Description of Related Art

Curtains on buildings are used for blocking sunlight, privacy protection and decoration. The curtain is open or closed by a fabric sliding in rails while the movement of the fabric is controlled by a cord or a bead chain.

Most of curtain cords are disposed with a weight to pull them down. When wind blows, the weight on the cord hits walls and makes annoying noises. Moreover, curtain cords can pose a serious risk to children. Children may place loose curtain cords over their heads and get tangled in loose cords while playing near hanging cords. The cord wrapped around children's neck strangles them to dead. Or children jump to reach the cord and fall from windows. There are deaths reported every year.

Thus there is room for improvement and a need to provide a safety retainer for curtain cords that solves above problems.

SUMMARY OF THE INVENTION

Therefore it is a primary object of the present invention to provide a safety retainer for curtain cords that fixes curtain cords in a place that is out of reach of children for children's safety.

In order to achieve the above object, a safety retainer for holding curtain cords that open and close curtains according to the present invention includes an inner base and an outer base, respectively disposed with a fixing hole. The curtain cord that controls curtains is passed through the fixing holes of the inner base and the outer base correspondingly. Then the inner and outer bases are fixed on a wall. Thereby the curtain cord is secured by the safety retainer and is out of reach of children so that they don't become entangled in the curtain cord.

The safety retainer for curtain cords further includes connection rod sections arranged in the inner base and the outer base. An elastic member is set around and between the two connection rod sections. Due to the elastic members against the inner base and the outer base, the fixing holes are in a staggered arrangement to hold the curtain cord. Thus the safety retainer, even not being assembled on a wall, can still secure the cord stably.

Moreover, locking members are disposed on the locking blocks while the locking slots corresponding to the locking members are arranged at an inner wall of the outer base. Thus the locking member is moved in the corresponding locking slot while the inner base and the outer base are against by the elastic members.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
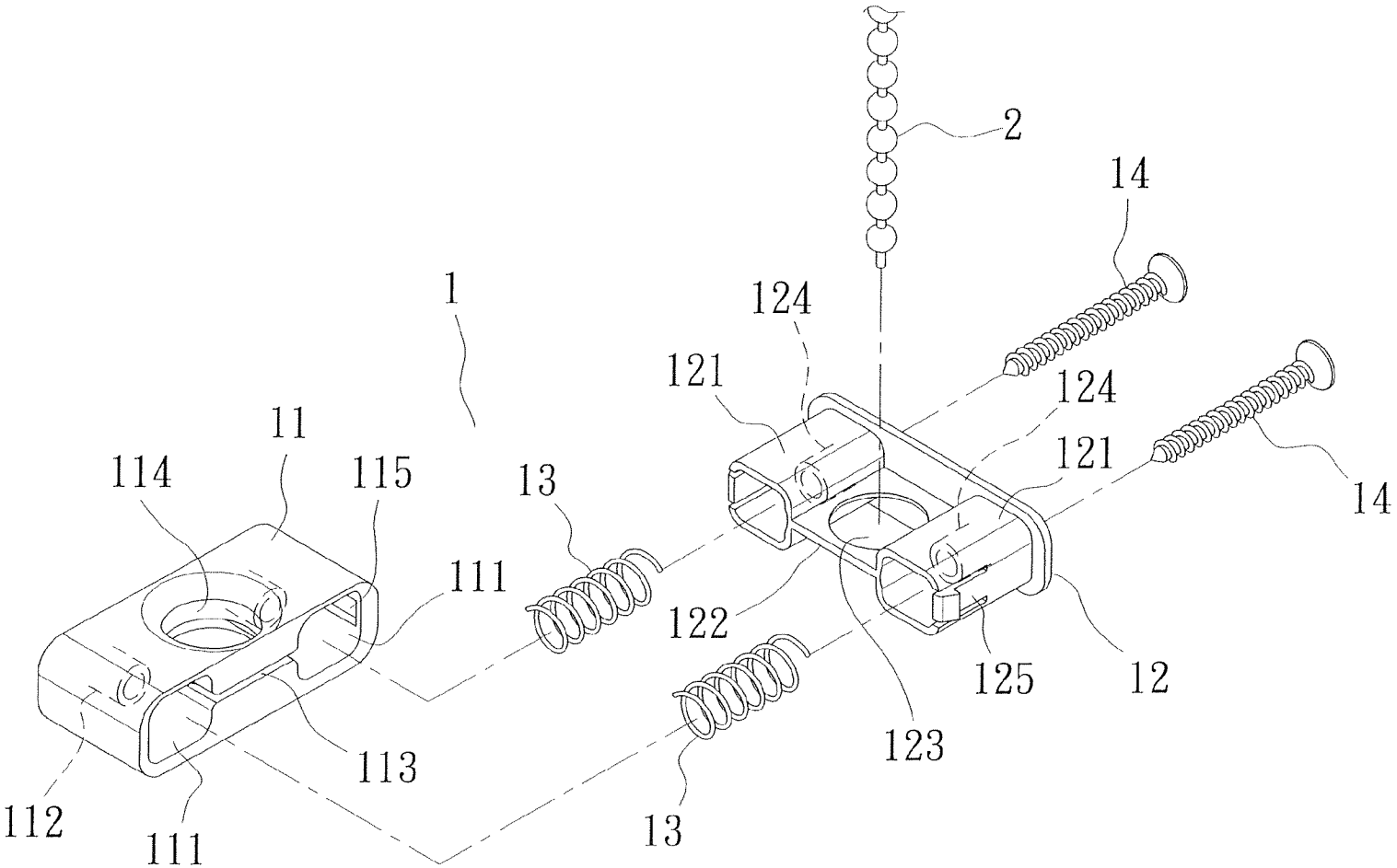
FIG. 1 is an explosive view of an embodiment according to the present invention.
Figure 2:
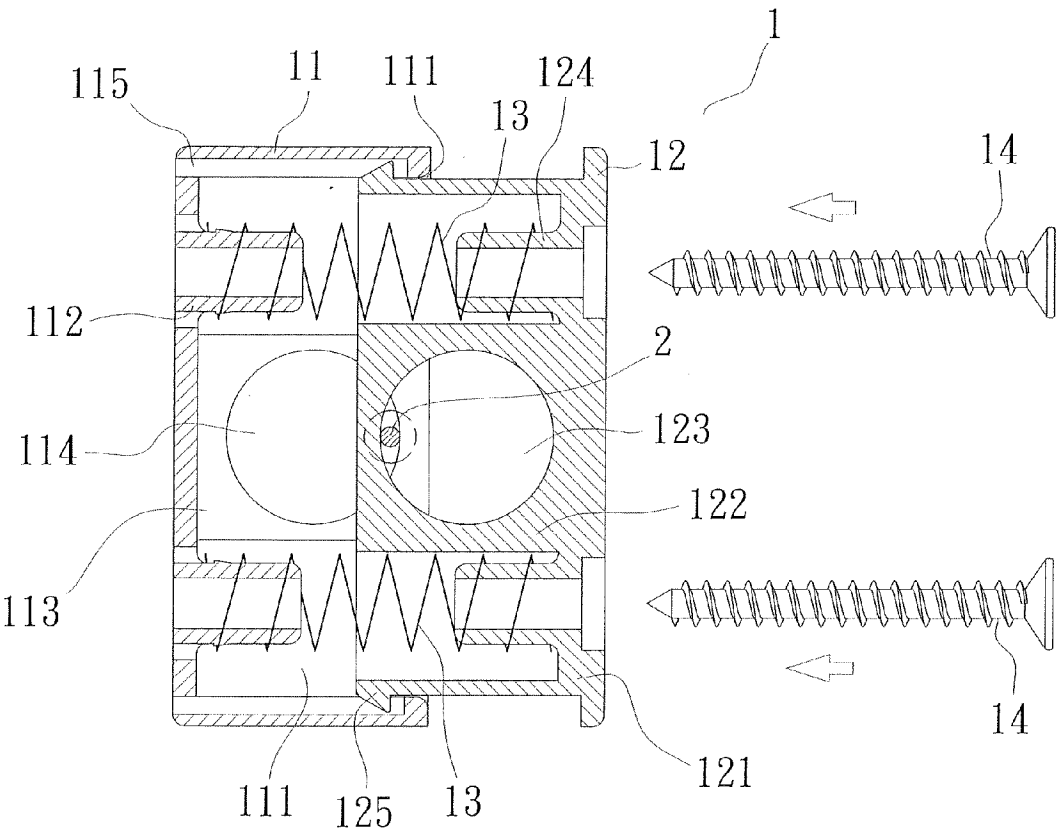
FIG. 2 is an assembly view of an embodiment according to the present invention.
Figure 3:
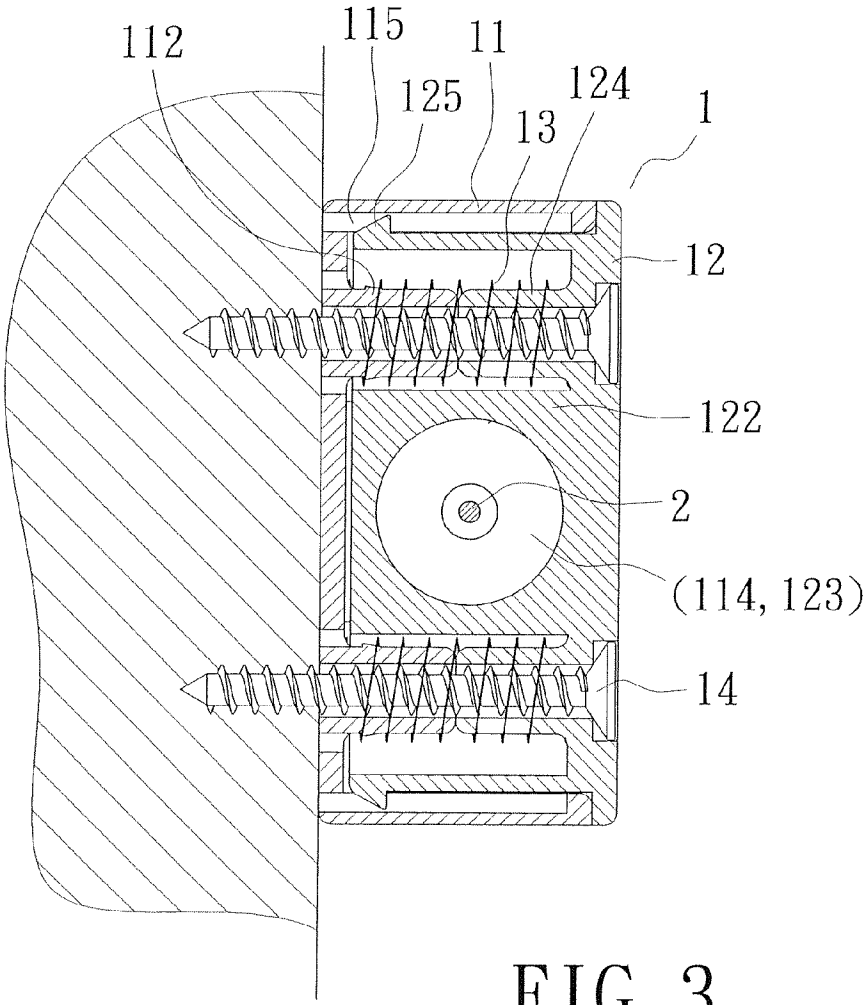
FIG. 3 is cross sectional view of an embodiment according to the present invention.

Refer to FIG. 1 to FIG. 3, a safety retainer 1 for fixing a cord 2 that is used to open and close curtains includes an outer base 11, an inner base 12 and two elastic members 13.

The outer base 11 consists of two long holes 111, two connection rod sections 112 each of which extended from a bottom of each long hole 111, a channel 113 that communicates the two long holes 111, a fixing hole 114 that is a through hole and communicating with the channel 113 and two locking slots 115 disposed on an inner wall of each long hole 111 respectively. A center of the connection rod section 112 is a through hole.

The inner base 12 is composed of two locking blocks 121, a connection piece 122 connecting the two locking blocks 121, a fixing hole 123 arranged at the connection piece 122, two connection rod sections 124 and two locking members 125. The two locking blocks 121 and the connection piece 122 are respectively mounted into each long hole 111 and the channel 113 of the outer base 11. The connection rod section 124 having a through hole at a center thereof is extended from a bottom of each locking block 121 and is corresponding to the connection rod section 112 of the outer base 11. The locking members 125 are disposed on outer surfaces of the locking blocks 121 and corresponding to the locking slots 115 of the long holes 111 respectively.

Each of the two elastic members 13 is disposed around the connection rod section 124 of the inner base 12 and the connection rod section 112 of the outer base 11.

Refer to FIG. 1 to FIG. 5, while being assembled, the locking blocks 121 and the connection piece 122 of the inner base 12 are respectively mounted into the long holes 111 and the channel 113 of the outer base 11. Before this mounting process, the elastic members 13 are arranged around the connection rod sections 124, 112 of the inner base 12 and the outer base 11 correspondingly. After the mounting, the inner base 12 and the outer base 11 are assembled with each other by the locking member 125 of the locking blocks 121 being locked with the corresponding locking slot 115 on the inner wall of the long hole 111. Now the elastic members 13 are stretched so that the fixing hole 123 of the inner base 12 and the fixing hole 114 of the outer base 11 are not aligned with each other. The fixing holes 114, 123 are in a staggered arrangement. Then the inner base 12 and the outer base 11 are pressed toward each other to compress the elastic members 13, allowing the two fixing holes 123, 114 aligned. Next the cord 2 used to open and close curtains is passed through the fixing holes 123, 114. When the inner base 12 and the outer base 11 are released, the two fixing holes 123, 114 become staggered again and the cord 2 is fixed. This is a free state of the safety retainer 1, not being assembled on a wall.

Figure 4:
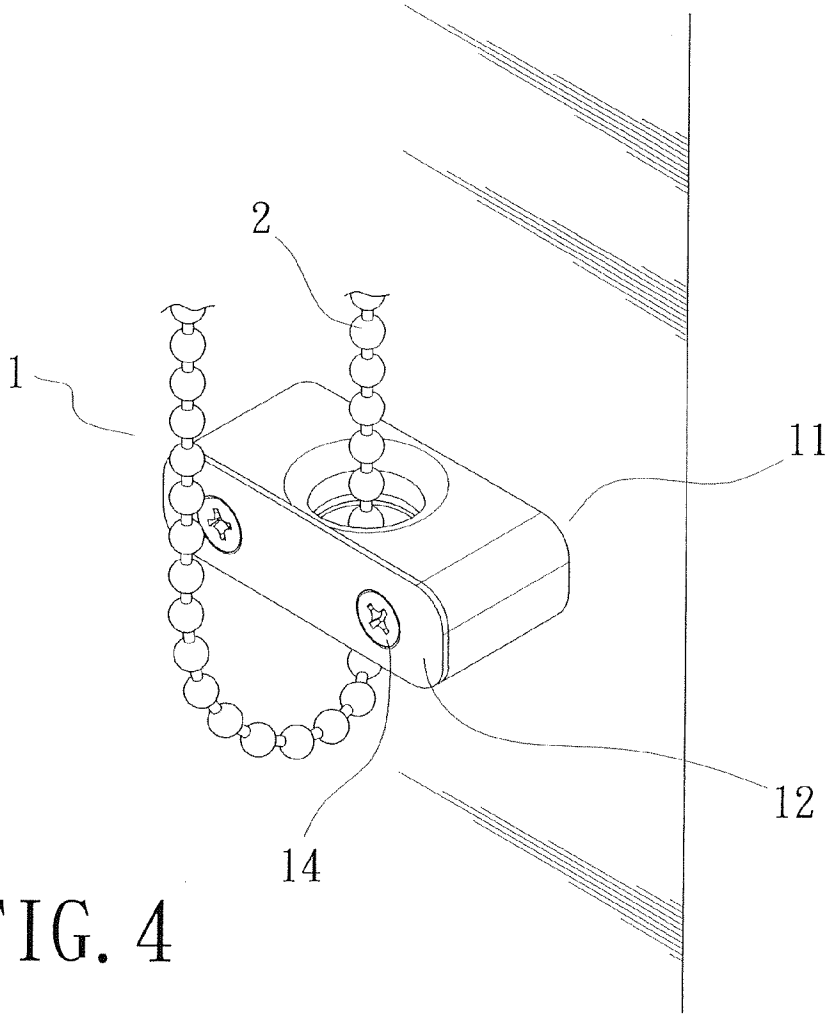
FIG. 4 is a schematic drawing showing an embodiment in use according to the present invention.
Figure 5:
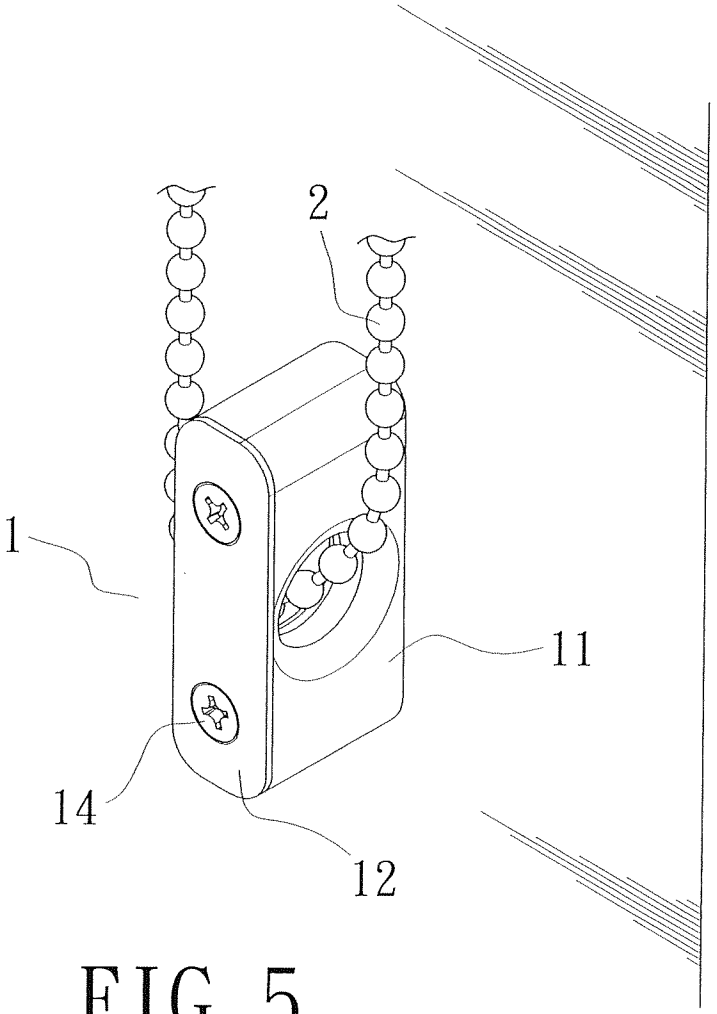
FIG. 5 is another schematic drawing showing an embodiment in use according to the present invention.

While in use, threaded fasteners 14 are inserted into the connection rod sections 124 at the center of the inner base 12, the connection rod sections 112 of the outer base 11 to be fastened and located on a wall that corresponds to the curtains. Thus the inner base 12 is pushed and mounted inside the outer base 11 and the elastic members 13 are in a compressed state. The locking members 125 of the locking blocks 121 are moved along the locking slots 115 on the inner wall of the long holes 111 respectively. Then the inner base 12 and the outer base 11 are fixed on the wall and the two fixing holes 123, 114 are aligned, as shown in FIG. 4 and FIG. 5. The cord 2 is secured in the fixing holes 123, 114. Therefore the cord 2 is held in place by the safety retainer 1 while the safety retainer 1 is fixed on the wall and out of reach of kids for preventing accidents.

In summary, the safety retainer for curtain cords of the present invention has following advantages compared with the curtain cord retainers available now:

1. Curtain cords secured by the safety retainer are ensured to be out of reach of children. Thus kids are out of danger. Moreover, curtain cords make no noise. The risk cords posed on children is reduced and there is no more annoying sound.
2. By the design of the elastic members around the inner and the outer bases, the curtain cords can be secured by the safety retainer before the safety retainer being mounted onto the wall. Users can hold the curtain cords by the safety retainer easily.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A safety retainer for curtain cords used to secure at least one cord that opens and closes curtains comprising: an outer base, an inner base and two elastic members;

wherein the outer base includes two long holes, a connection rod section respectively extended from a bottom of each of the long holes, a channel communicating between the two long holes, a fixing hole that is a through hole and communicates with the channel and a locking slots respectively arranged at an inner wall of each long hole; a through hole at the center of each connection rod section;

the inner base having two locking blocks, a connection piece connecting the two locking blocks, a fixing hole disposed on the connection piece, two connection rod sections and two locking members; the two locking blocks and the connection piece are correspondingly mounted into the two long holes and the channel of the outer base; each connection rod section having a through hole at a center thereof disposed on a bottom of each locking block and corresponding to one of the connection rod sections of the outer base; each of the locking members is arranged on one of the locking blocks and is corresponding to the locking slot of one of the long holes of the outer base;

each elastic member is disposed around the connection rod section of the inner base and the connection rod section of the outer base;

wherein while being assembled, the fixing holes of the inner and outer base are in a staggered arrangement and said at least one curtain cord can be fixed therethrough; and wherein, in use, threaded fasteners can be inserted into the connection rod sections of the inner and outer base for fastening the safety retainer to a wall wherein the inner base and outer base are pressed toward each other compressing said elastic members and aligning the two fixing holes allowing said at least one curtain cord to be passed therethrough.

* * * * *